US007926459B2

(12) United States Patent
Hahn et al.

(10) Patent No.: US 7,926,459 B2
(45) Date of Patent: Apr. 19, 2011

(54) DEVICE FOR OPENING AND CLOSING A VALVE OF A VALVE ASSEMBLY OF A COMBUSTION ENGINE AS WELL AS FOR ADJUSTING THE STROKE OF THE VALVE

(75) Inventors: Joachim Hahn, Hofheim am Taunus (DE); Ulrich Karrer, Mainz (DE)

(73) Assignees: Hyundai Motor Company, Seoul (KR); Kia Motors Corporation, Seoul (KR); Hyundai Motor Europe Technical Center GmbH, Russelsheim (DE)

( * ) Notice: Subject to any disclaimer, the term of this patent is extended or adjusted under 35 U.S.C. 154(b) by 262 days.

(21) Appl. No.: 12/361,847

(22) Filed: Jan. 29, 2009

(65) Prior Publication Data

US 2010/0101374 A1 Apr. 29, 2010

(30) Foreign Application Priority Data

Oct. 23, 2008 (DE) ..... 10 2008 043 139

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 6,886,512 B2 * 5/2005 Naumann ..... 123/90.39

FOREIGN PATENT DOCUMENTS

WO WO 2005/059321 A1 6/2005

* cited by examiner

*Primary Examiner* — Ching Chang
(74) *Attorney, Agent, or Firm* — Morgan, Lewis & Bockius LLP

(57) ABSTRACT

A device for actuating a valve of a valve assembly of an engine and for adjusting a stroke of the valve, may include a camshaft including a cam, a working curve member provided pivotably about the camshaft for actuating the valve, a lever holder which is provided pivotably about the camshaft, a lever, one end of which is spaced from the camshaft with a predetermined distance and pivotally coupled to the lever holder, and a connecting link pivotally connected to the lever and the working curve member.

15 Claims, 3 Drawing Sheets

DEVICE FOR OPENING AND CLOSING A VALVE OF A VALVE ASSEMBLY OF A COMBUSTION ENGINE AS WELL AS FOR ADJUSTING THE STROKE OF THE VALVE

CROSS-REFERENCE TO RELATED APPLICATION

The present application claims priority to German Patent Application No. 102008043139.7 filed in the German Intellectual Property Office on Oct. 23, 2008, the entire contents of which are incorporated herein for all purposes by this reference.

BACKGROUND OF THE INVENTION

1. Field of the Invention

The present invention relates to a device for opening and closing a valve of a valve assembly of a combustion engine as well as for adjusting the stroke of the valve, and it furthermore relates to a combustion engine.

2. Description of Related Art

Although applicable to any combustion engine, the present invention and the problem on which it is based are described in more detail with respect to an Otto engine.

Due to dwindling resources and in order to protect the environment, it is mandatory to reduce the fuel consumption of Otto engines even further. Engine power, however, shall not be lost as a consequence of reducing the fuel consumption. This can only be accomplished by increasing the efficiency of the Otto engine.

An approach for increasing the efficiency of the Otto engine is described in WO 2005/059321. According to the approach, the throttle valve is removed, which was used so far to control the volume of fuel air mixture that reaches the combustion chamber of the Otto engine, since considerable flow losses occur at the valve, which reduces the efficiency of the Otto engine. The throttle function is assumed by the valves which are provided with variable stroke, thus controlling the volume of the fuel air mixture that reaches the combustion chamber of the Otto engine.

This approach, however, has proven to be disadvantageous insofar as the camshaft must be offset considerably from its conventional position in Otto engines without variable valve stroke control. For example, a conversion from an Otto engine without variable valve stroke control to an Otto engine with such control requires expensive adaptations of the design of the Otto engine, and particularly of the cylinder head, as well as of the production means.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an improved device as well as an improved combustion engine which avoids the above-mentioned disadvantages.

In an aspect of the present invention, a device for opening and closing a valve of a valve assembly of a combustion engine and for adjusting a stroke of the valve may include a camshaft which has a cam, a working curve member for actuating the valve assembly for opening and closing the valve, wherein the working curve member is provided pivotably about the camshaft, a lever holder pivotably mounted about the camshaft, a lever, one end of which is spaced from the camshaft with a predetermined distance and pivotably coupled to the lever holder, the lever bearing against the cam for being pivoted with respect to the lever holder, and a connecting link, which pivotably interconnects the working curve member and the lever, wherein the camshaft, the cam, the working curve member, the lever holder, the lever and the connecting link are configured and disposed relative to one another so that the valve opens and closes by rotation of the camshaft and the stroke of the valve is adjustable by pivoting the lever holder about the camshaft.

Furthermore, a combustion engine is provided, including at least one valve assembly having a valve disposed in an inlet of a combustion chamber of the combustion engine and including the device according to the present invention.

In another aspect of the present invention, the working curve member and the lever holder is disposed concentrically with the camshaft to provide on the one hand a highly compact device. On the other hand the camshaft can therefore remain in the vicinity of its conventional position in combustion engines with variable valve stroke control. A conversion from a combustion engine without variable valve stroke control to a combustion engine with such control is therefore possible with no or only slight adaptation of the design of the combustion engine and the production means. This results in a comparatively low cost solution.

In another aspect of the present invention, the pivoting of the lever holder about the camshaft by a predetermined angle also activates the pivoting of the working curve member about the camshaft. This is particularly favorable in terms of a return spring to be used. Due to the present configuration, the position of the valve opening changes relative to the angular position of the lever holder rotatably connected to the crankshaft as a function of the stroke. In an advantageous embodiment this helps meet the requirement for an "early inlet closure" with reduced stroke. This enables the camshaft phase switch to be simplified.

In the present invention, a "contact means" refers in particular to a surface, a roller and/or a sliding element. In the present invention, a contact means is used for transferring a movement between two components.

In the present invention, the "stroke" of the valve refers to the distance covered by the valve between its bottom and top dead centre.

In the present invention "rotatable about the camshaft" refers to a rotation about the camshaft centerline.

In another aspect of the present invention, the lever holder is supported on the camshaft. In this case, the camshaft is supported in the housing of the combustion engine. Furthermore, with respect to the coaxial support of camshaft and lever holder, it is possible to support both independently in the housing of the combustion engine. Alternatively, the support of the lever holder can be performed in the housing, and the support of the camshaft can be performed in the lever holder.

In another aspect of the present invention, the lever holder is coupled to an electronically and/or mechanically controllable drive for pivoting in a defined manner. Thus, the stroke of the valve can be controlled, for example, according to the desired output of the combustion engine. Such a drive may, for example, be an electric stepper motor.

In another aspect of the present invention, a return spring is provided which has an annular portion and two legs projecting from it, wherein the annular portion is disposed concentrically to the camshaft, one of the legs is fitted to the working curve member and the other leg to the lever holder. Such a return spring is also referred to as a coiled torsion spring. Because the pivoting of the lever holder about the camshaft by a predetermined angle also simultaneously requires the pivoting of the working curve member about the camshaft by the same angle, the legs of a return spring thus fitted are bent to the same degree relative to one another when the camshaft rotates, irrespective of the position of the lever holder relative to the camshaft. This means that the initial and end position of the two legs of the return spring relative to one another is the same for each position of the lever holder relative to the camshaft. The return force generated by the return spring during the rotation of the camshaft is therefore always the same, thereby in turn facilitating the kinematic design of the device.

In another aspect of the present invention, the lever has a first and a second section, wherein the first section is fitted at its one end pivotably to the lever holder and at its other end abuts against the second section, wherein the second section extends at an inclined angle to the camshaft relative to the first section and the second section is fitted at its end facing away from the first section pivotably to the connecting link. Therefore the extension of the device in a plane perpendicular to the camshaft can be reduced still further, i.e. an even more compact device can therefore be provided.

In another aspect of the present invention the lever has a contact member, in particular a rotatably mounted roller element, in the region in which the first and second sections abut against one another, which element bears against the cam. In this region the roller element can be integrated in the lever in a space-saving manner. The use of a roller contact offers advantages in terms of frictional behavior.

In another aspect of the present invention, the lever holder is designed as a housing which, in the axial direction of the camshaft, encloses the working curve member, the cam, the return spring, the connecting link and/or the lever. In this case the housing is designed preferably with a comparatively thin wall. This provides an even more compact design of the device according to the invention. Moreover, the components are located inside the lever holder designed as a housing so that they are protected inside same.

In another aspect of the present invention it has a further connecting link, a further working curve member and/or a further return spring, wherein a plane of symmetry intersects the camshafts essentially perpendicularly and runs through the cam, the lever and the housing. A variable valve stroke control for two valves can therefore advantageously be provided with only one lever holder, one cam and one lever. Components can therefore be dispensed with.

In another aspect of the present invention, the lever is fitted pivotably to lever holder and/or to a connecting link, in particular by means of pins, viewed perpendicularly to the camshaft, on both sides. This type of lever is loaded symmetrically on both sides, which can result in a simplified support of the same. In particular, bending moments can be reduced.

In another aspect of the present invention, the valve assembly includes a roller cam follower or a bucket tappet contacting the second working curve member and converting a pivoting movement of same into a linear movement of the valve for opening and closing same. Roller cam followers or bucket tappets are preferred according to the present invention, but other mechanisms are also conceivable for converting the pivoting movement into a linear movement.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

In the figures the same components are denoted by the same reference symbols, unless otherwise indicated.

Figure 1:
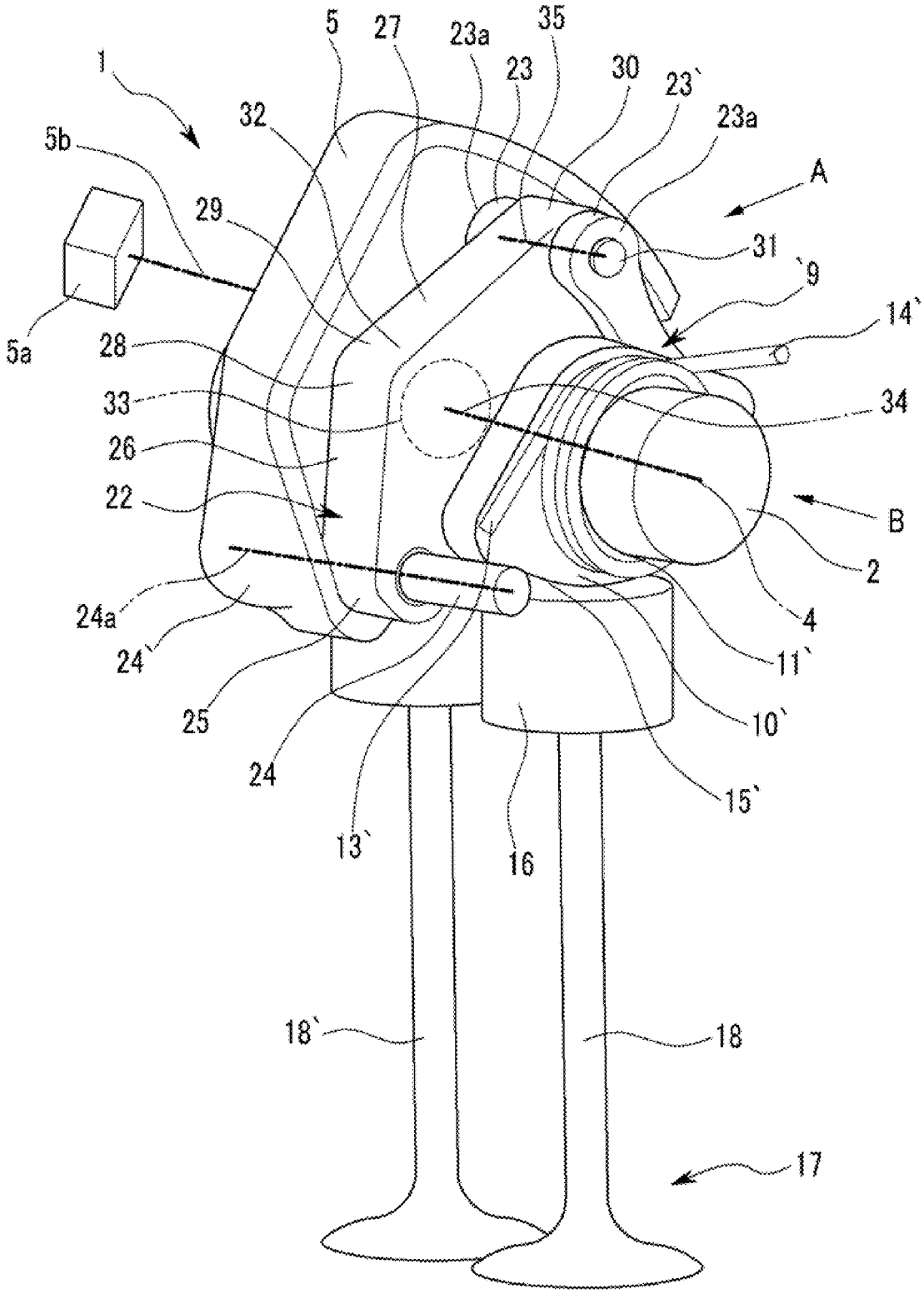
FIG. 1 shows a perspective view of a section of an exemplary combustion engine including a device according to the present invention.
Figure 2:
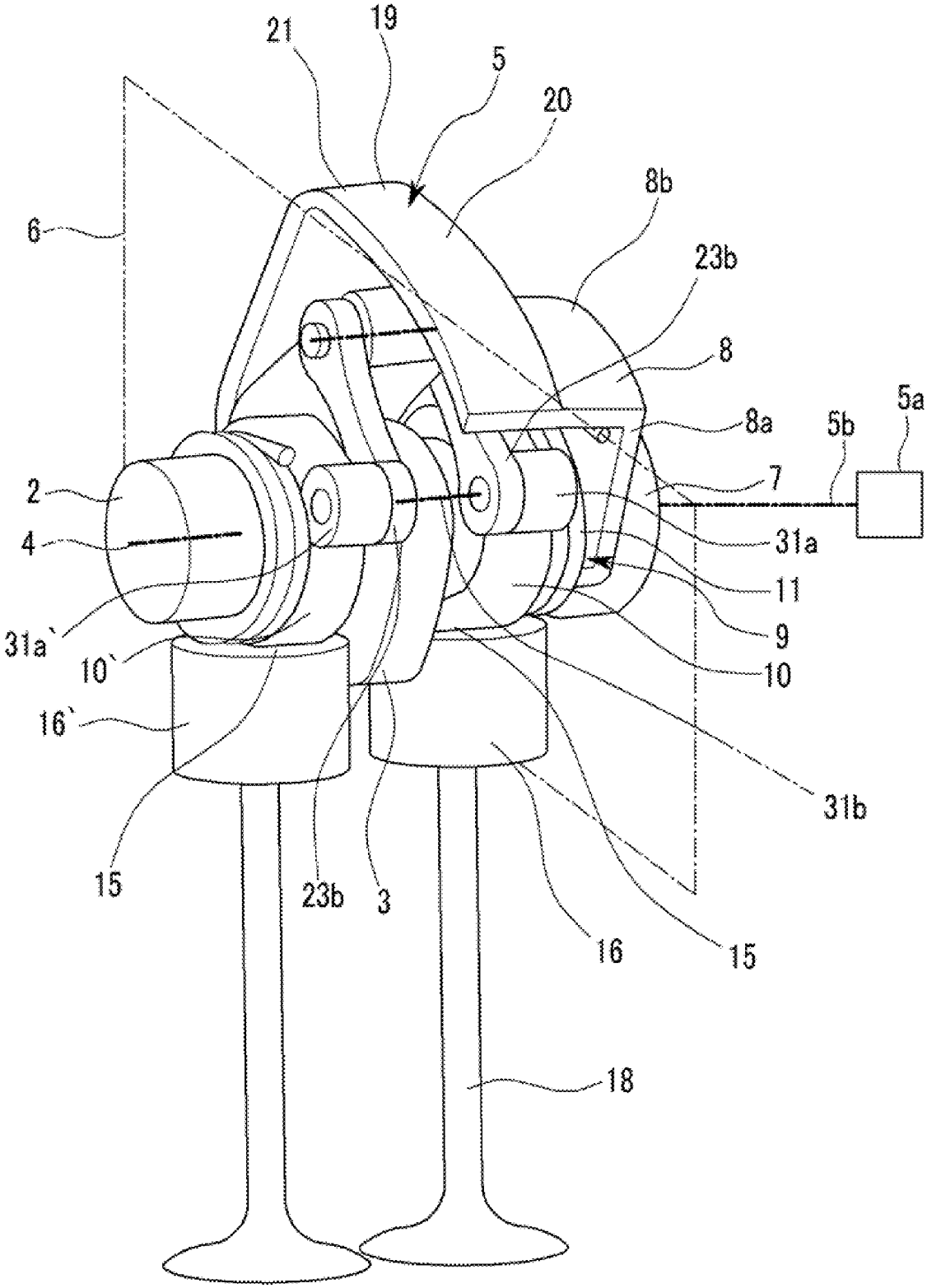
FIG. 2 shows a perspective view A from FIG. 1.
Figure 3:
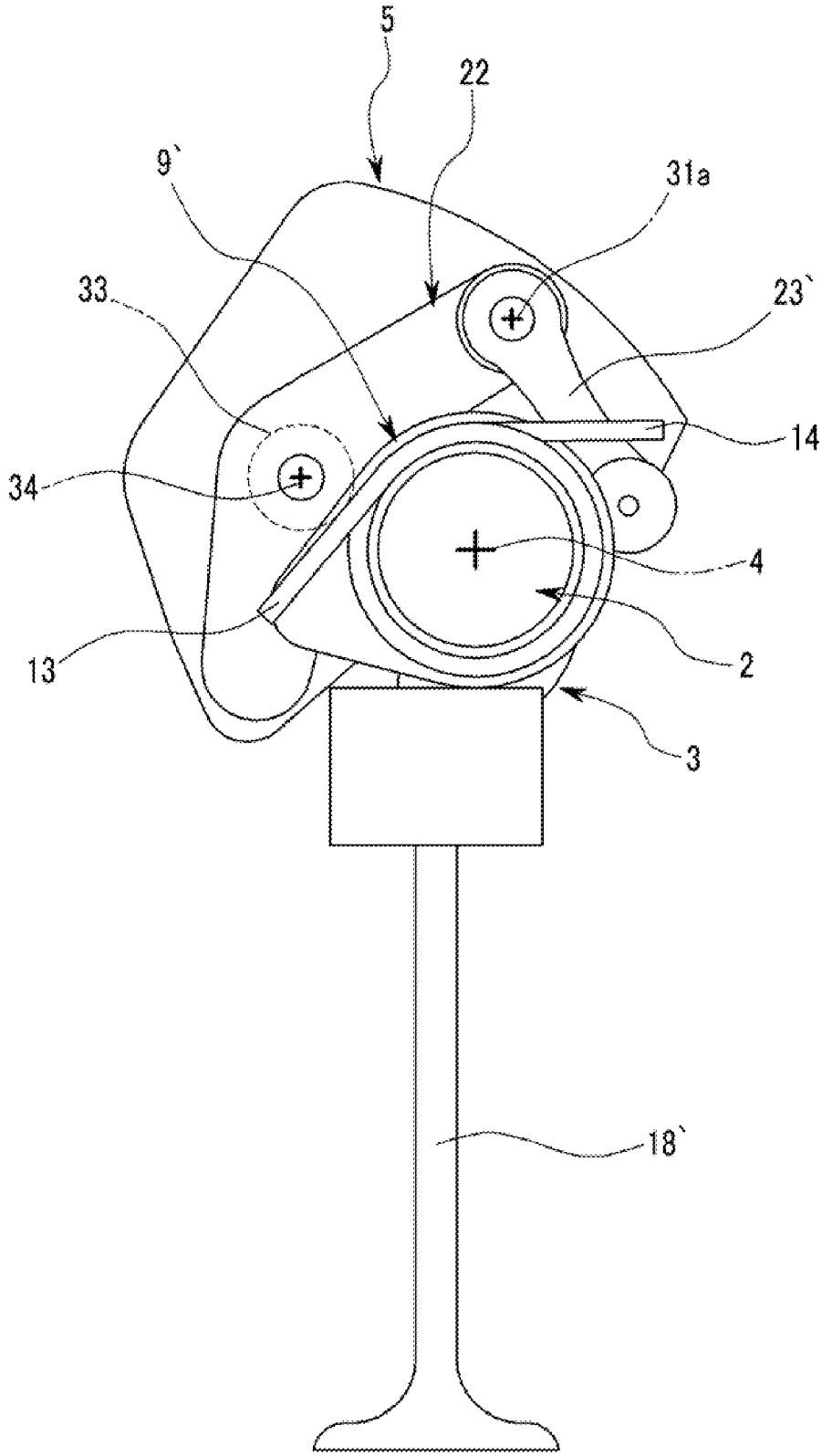
FIG. 3 shows a side view B from FIG. 1.

The section of a combustion engine, for example an Otto engine, according to FIGS. 1 to 3, shows a device 1 which has a camshaft 2 with a cam 3. Camshaft 2 is rotated at half the speed of a crankshaft of the Otto engine, not shown in further detail, about its rotation axis 4. Camshaft 2 is connected preferably integrally to cam 3.

Device 1 also has a lever holder 5, only half of which is shown, for reasons of clarity, viewed perpendicularly to camshaft 2.

According to various embodiments device 1, together with a valve assembly 17 of the Otto engine, have a plane of symmetry 6 transverse to camshaft 2, see FIG. 2. In the following, corresponding, symmetrically arranged components are denoted by the reference symbol ', for example 9'.

Lever holder 5 has a preferably annular section 7 through which camshaft 2 extends. Lever holder 5 may be mounted directly on camshaft 2 or by means of separate bearing means, not shown. Moreover, lever holder 5 is provided so that it is pivotal about camshaft 2, i.e. about its rotation axis 4, for example by means of an adjusting device 5*a*, such as a step motor—only shown in FIG. 1 for the sake of clarity—defined about camshaft 2, in particular as a function of an engine control signal. The adjusting device 5*a* may be operably connected to the lever holder 5 by a control member 5*b* wherein the control member 5*b* is disposed to effect rotation of the lever holder 5*b* about to rotation axis 4 of the camshaft 2.

According to various embodiments, lever holder 5 is designed as a housing. A step 8 of comparatively thin-walled material is connected to annular section 7, which step receives in its interior a return spring 9 and a working curve member 10. Step 8 has a radial section 8*a*, which extends in the radial direction from annular section 7, and an axial section 8*b* connected to radial section 8*a*, which section extends in the axial direction (relative to the camshaft). Viewed perpendicularly to camshaft 2, annular section 7, return spring 9 and working curve member 10 abut approximately against one another.

Return spring 9 has an annular section 11 consisting of one or more turns of spring wire. Annular section 11 is disposed concentrically to camshaft 2. Return spring 9 is shown covered in FIG. 2. Its structure is explained in more detail in the following with reference to return spring 9' arranged symmetrically to plane of symmetry 6. Two legs 13' and 14', each of spring wire, are provided on annular section 11'. Leg 14' is fitted to lever holder 5 in the region of step 8'. Leg 14' preferably bears against axial section 8*b*' of step 8'. Leg 13' of return spring 9' is fixed to working curve member 10'.

The working curve member 10, 10' is provided pivotally on camshaft 2 and has a contoured surface 15, 15', which is formed against a bucket tappet 16, 16' of a valve assembly 17 suitable for actuating a valve 18, 18'. Valves 18, 18' are arranged according to the present exemplary embodiment in an inlet of a combustion chamber of the Otto engine.

To step 8 of lever holder 5 is connected a step 19, with a radial section 20 which is connected to axial section 8*b* of step 8, and with an axial section 21 which is connected to radial section 20. Step 19 encloses, in a symmetrically structured lever holder 5, a lever 22 and connecting links 23 and 23' of device 1.

Lever 22 is provided so that it pivots about an axis 24*a* at its one end 25 by means of pins 24, 24', for example, on lever holder 5.

Lever 22 consists of two sections 26, 27. Section 26 has two ends, end 25 and an end 28 with which it abuts against one end 29 of section 27 in a region 32. Section 27 extends inclined towards camshaft 2, at an angle of between 30 and 60°, for example, relative to section 26.

The lever 22 may include the connecting links 23, 23'. At the other end 30 of section 27, one ends 23*a*, 23*a*' of connecting links 23 and 23' are each coupled by pins 23 and 23'.

The other ends 23*b*, 23*b*' of the connecting links 23, 23' are coupled to a projection 31*a*, 31*a*' formed on the working curve member 10, 10', essentially opposing the contoured surface 15, 15' thereof so that the pivotal motion of the lever 22 can be transferred to the working curve member 10', 10.

In various embodiments of the present invention, the projection 31*a*, 31*a*' can be welded to the working curve member 10, 10' to form a single body.

A roller element 33 is provided to the lever 22 so that it is pivoted in an integrated manner with lever 22 with respect to the axis 24*a*. The rotation axis of roller element 33 is denoted by the reference number 34 and runs essentially parallel to rotation axis 4, 24*a*, 35, and 31*b* respectively.

Roller element 33 is in contact with cam 3 and rolls off on it whilst camshaft 2 rotates.

Following this essentially structural description of the device according to the invention its principle of operation will now be explained.

During the operation of the Otto engine camshaft 2 rotates cam 3, the latter pivoting the lever 22 about rotation axis 24*a* by the action of cam 3 on roller element 33. In this case, end 27 of lever 22 obviously also pivots about axis of pivoting 24', thereby causing working curve members 10, 10' to be pivoted by means of connecting links 23, 23' connected to the lever 22 about camshaft 2, i.e., rotation axis 4.

Here contoured surfaces 15, 15' of working curve members 10, 10' act on bucket tappets 16, 16', causing in turn valves 18, 18' to be displaced backwards and forwards for opening and closing.

The task of return spring 9, 9' is to move extended working curve member 10, 10' from its extended position (valve 18, 18' open) into its retracted position (valve 18, 18' closed), as shown in FIGS. 1 to 3.

Now if more engine output is required, an electrical signal is transmitted to adjusting device 5*a*, whereupon this pivots lever holder 5 by a defined angle about camshaft 2. This in turn changes the position of lever 22, consequently that of connecting links 23, 23' and hence the position of contoured surface 15, 15', whereby the latter comes into contact with bucket tappet 16 or 16' in another region, finally causing the stroke of valve 18, 18' to change.

In particular, the design of lever holder 5 is variable and is not limited to the construction described above with the two steps 9, 19, which are connected to annular section 8.

Obviously the present invention can also be applied to diesel engines.

In particular, an asymmetrical construction may also be selected. An embodiment in which only one lever holder, one return spring, one working curve member, one connecting link and one cam per device is provided is always conceivable.

For convenience in explanation and accurate definition in the appended claims, the terms "forwards" and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A device (1) for opening and closing a valve (18, 18') of a valve assembly (17) of a combustion engine and for adjusting a stroke of the valve (18, 18'), comprising:

a camshaft (2), which has a cam (3);

a working curve member (10, 10') for actuating the valve assembly (17) for opening and closing the valve (18, 18'), wherein the working curve member (10, 10') is provided pivotably about the camshaft (2);

a lever holder (5) pivotably mounted about the camshaft (2);

a lever (22), one end of which is spaced from the camshaft (2) with a predetermined distance and pivotably coupled to the lever holder (5), the lever (22) bearing against the cam (3) for being pivoted with respect to the lever holder (5); and a connecting link (23, 23'), which pivotably interconnects the working curve member (10, 10') and the lever (22), wherein the camshaft (2), the cam (3), the working curve member (10, 10'), the lever holder (5), the lever (22) and the connecting link (23, 23') are configured and disposed relative to one another so that the valve (18, 18') opens and closes by rotation of the camshaft (2) and the stroke of the valve (18, 18') is adjustable by pivoting the lever holder (5) about the camshaft (2).

2. The device according to claim 1, further comprising an adjusting device (5*a*) connected to the lever holder (5) so as to control a position of the lever holder (5) about the camshaft (2).

3. The device according to claim 2, wherein the adjusting device (5*a*) includes a control member (5*b*) connected to the lever holder (5), the control member (5*b*) and the camshaft (2) being aligned coaxial.

4. The device according to claim 1, wherein an elastic member is provided on the camshaft (2) to provide a restoring force to the working curve member (10, 10') when a pivoting force applied to the working curve member (10, 10') is removed.

5. The device according to claim 4, wherein one end of the elastic member is coupled to the working curve member (10, 10') and the other end of the elastic member is slidably received in the lever holder (5).

6. The device according to claim 5, wherein the elastic member is a return spring (9, 9') which has an annular section (11, 11') and two legs (13, 13', 14, 14') projecting from it, wherein the annular section (11, 11') is disposed concentrically with respect to the camshaft (2) and wherein one of the legs (13, 13') is fitted to the working curve member (10, 10'), and the other leg (14, 14') is slidably fitted to the lever holder (5).

7. The device according to claim 4, wherein the lever holder (5) is configured to receive, in axial direction of the camshaft (2), the working curve member (10, 10'), the cam (3), the elastic member, the connecting link (23, 23') and/or the lever (22).

8. The device according to claim 4, wherein the device (1) has a further connecting link (23'), a further working curve member (10') and/or a further elastic member, wherein the device (1) has a plane of symmetry (6) which intersects the camshaft (2) essentially perpendicularly and runs through the cam (3), the lever (22) and the lever holder (5).

9. The device according to claim 1, wherein the lever (22) has a first and second sections (26, 27) connected each other with a predetermined angle therebetween, one end of the first section (26) pivotably coupled to the lever holder (5) and one end of the second section (27) is coupled to the connecting link (23, 23').

10. The device according to claim 9, wherein the predetermined angle ranges between approximately 30 degrees and approximately 60 degrees.

11. The device according to claim 9, wherein the lever (22) has a contact member in the region (32) in which the first and second section (26, 27) abut against one another, the contact member bearing against the cam (3).

12. The device according to claim 11, the contact member is a roller.

13. The device according to claim 1, wherein the lever (22) is fitted pivotably to the lever holder (5) and/or to the connecting link (23, 23'), by pins (24, 24', 31), viewed perpendicularly to the camshaft (2), on both sides.

14. A combustion engine comprising at least one valve assembly (17) which has a valve (18, 18') which is arranged in an inlet of a combustion chamber of the combustion engine, and at least one device (1) according to claim 1.

15. The combustion engine according to claim 14, wherein the valve assembly (1) has a roller cam follower or a bucket tappet (16, 16') which bears against the working curve member (10, 10') and converts a swivel movement of cam into a linear movement of the valve (18, 18') for opening and closing same.

* * * * *